US005762464A

United States Patent [19]

Hertelendi

[11] Patent Number: 5,762,464

[45] Date of Patent: Jun. 9, 1998

[54] RAILROAD CAR FOR LOADING AND UNLOADING RAILS

[75] Inventor: Josef Hertelendi, Freilassing, Germany

[73] Assignee: Georg Robel GmbH & Co., Munich, Germany

[21] Appl. No.: 665,540

[22] Filed: Jun. 18, 1996

[30] Foreign Application Priority Data

Jul. 4, 1995 [DE] Germany ..... 195 24 285.8

[51] Int. Cl.[6] ..... B65G 13/00

[52] U.S. Cl. ..... 414/486; 414/338; 414/529; 104/2

[58] Field of Search ..... 414/338, 339, 414/350, 486, 679, 501, 529; 104/2

[56] References Cited

U.S. PATENT DOCUMENTS

| | | | |
|---|---|---|---|
| 3,635,164 | 1/1972 | Patton | 104/2 X |
| 4,099,635 | 7/1978 | Leonard et al. | 414/339 X |
| 4,502,389 | 3/1985 | Theurer et al. | 104/2 |
| 4,867,068 | 9/1989 | Valditerra | 414/501 X |
| 5,195,436 | 3/1993 | Valditerra | 104/2 X |
| 5,222,435 | 6/1993 | Theurer et al. | 104/2 |
| 5,469,791 | 11/1995 | Theurer et al. | 104/2 X |
| 5,511,484 | 4/1996 | Theurer et al. | 104/2 |
| 5,520,497 | 5/1996 | Hertelendi et al. | 414/529 |
| 5,664,498 | 9/1997 | Theurer et al. | 104/2 X |

FOREIGN PATENT DOCUMENTS

| | | | |
|---|---|---|---|
| 1208326 | 1/1966 | Germany . | |
| 253851 | 4/1967 | Germany | 414/501 |
| 2734748 | 12/1979 | Germany . | |

*Primary Examiner*—Stephen T. Gordon
*Attorney, Agent, or Firm*—Collard & Roe, P.C.

[57] ABSTRACT

A car for loading and unloading elongated rails comprises a frame supported on a track by undercarriages, the frame defining at least one clearance between the undercarriages for permitting the elongated rails to be guided therethrough, a guiding roller arrangement arranged to guide a respective one of the elongated rails through the clearance between the track plane and a loading plane above the frame, the guiding roller arrangement being positioned in the clearance, and two rails for supporting a crane, the rails being affixed to the frame and extending in the longitudinal direction, the rails being spaced from each other in a direction extending transversely to the longitudinal direction.

9 Claims, 2 Drawing Sheets

Fig. 3
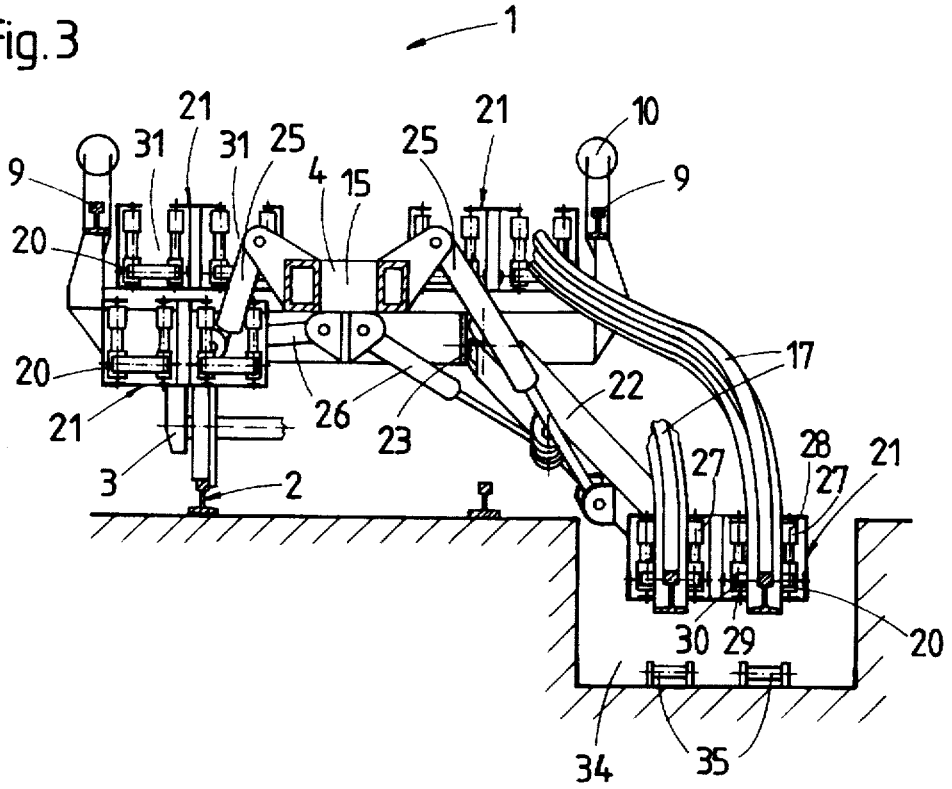
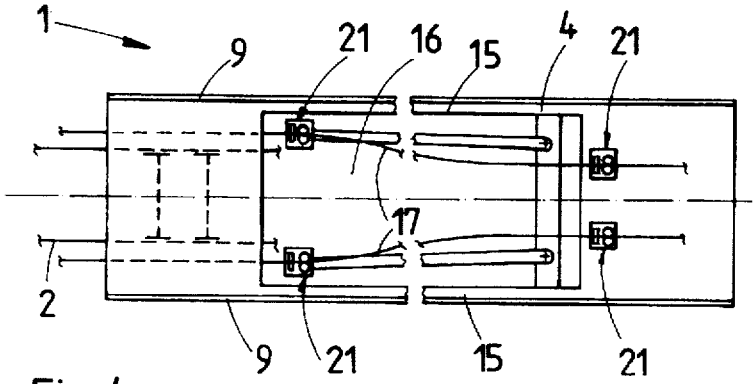
Fig. 4

RAILROAD CAR FOR LOADING AND UNLOADING RAILS

BACKGROUND OF THE INVENTION

1. Field of the Invention

The present invention relates to a car for loading and unloading elongated rails, the car being movable along a track extending in a longitudinal direction and defining a track plane. The car comprises a frame extending in the longitudinal direction and supported on the track by undercarriages, a guiding roller arrangement arranged to guide a respective one of the elongated rails between the track plane and a loading plane above the frame, and two rails for supporting a crane, the rails being affixed to the frame and extending in the longitudinal direction, and the rails being spaced from each other in a direction extending transversely to the longitudinal direction.

2. Description of the Prior Art

German patents Nos. 1,208,326 and 2,734,748, for example, disclose trains comprised of cars for loading and unloading elongated rails. To store the rails on the cars for transporting them, rail supports are spaced from each other in the longitudinal direction of the train on the frames of the cars, and the rail supports comprise support rollers arranged sequentially in a direction extending transversely to the longitudinal direction. The cars also have rails running along their sides and extending in the longitudinal direction for supporting a crane for loading and unloading the elongated rails. The car at an end of the train receiving the elongated rails during loading has guide rollers at an end of the car facing the train end for positioning and guiding the rails during loading and unloading. These guide rollers are immovably affixed to the car frame so that it is impossible, for example, to change the position of the unloaded rails with respect to the axis of the track on which the train runs.

SUMMARY OF THE INVENTION

It is the primary object of this invention to provide a rail transport car of the first-indicated type, which facilitates and simplifies the loading and unloading procedure.

The above and other objects are accomplished according to the invention with a frame which defines at least one clearance or recess between the undercarriages for permitting the elongated rails to be guided therethrough, the guiding roller arrangement being positioned in the clearance.

Such a clearance or recess in the frame enables the rails to be securely guided in a relatively wide transverse area of the track so that the elongated rails may be selectively guided and positioned either within or outside the gage of the track, depending on prevailing regulations or operating conditions. Since the guiding roller arrangement is positioned in the clearance, the guiding roller arrangement may be rapidly positioned for loading or unloading without requiring time-consuming retrofitting work.

If the frame comprises a carrier beam extending in the longitudinal direction and a respective one of the clearances is positioned on each side of the carrier beam which extends centrally between the clearances, there will be no problem in receiving the elongated rails far from the center at the shoulders of the track for loading, or to unload the rails on the shoulders.

On the other hand, if the frame comprises two carrier beams extending in the longitudinal direction and being spaced from each other in a direction extending transversely to the longitudinal direction, and the clearance is defined between the two carrier beams, the elongated rails may be loaded and unloaded between the track rails.

According to another preferred feature of the present invention, the undercarriages support opposite ends of the frame, the clearance is positioned between the two rails for supporting a crane and is delimited in the longitudinal direction by the undercarriages. This assures a guidance of the elongated rails without problems and avoids a plastic deformation of the rails as they are guided from the lower track plane to the higher loading plane.

Remote control of the rail guiding system enabling the elongated rails to be picked up and laid in a selected area of the track can be obtained if the guiding roller arrangement comprises an outrigger extending in the longitudinal direction and having opposite ends, and guiding roller means mounted on one of the outrigger ends, while a universal joint connects the outrigger end opposite to the one end to the frame. Preferably, the guiding roller means is pivotally mounted on the one outrigger end, and a drive links the guiding roller means to the one outrigger end for pivoting the guiding roller means. Furthermore, drive means may link the outrigger to the frame for adjusting the outrigger in a vertical direction and a direction extending transversely to the longitudinal direction.

According to another preferred feature, the car further comprises an operator's cab equipped with a central control mounted on an end of the frame remote from the universal joint.

Furthermore, the car may comprise a further guiding roller arrangement arranged to guide a respective one of the elongated rails between the track plane and a loading plane above the frame, the further guiding roller arrangement being mounted on the frame between the universal joint and an adjacent one of the undercarriages. This makes an exact rail guidance in connection with the pivotal outrigger possible even if the elongated rails are picked up from a relatively remote point on the shoulders.

BRIEF DESCRIPTION OF THE DRAWING

The above and other objects, advantages and features of this invention will become more apparent from the following detailed description of certain now preferred embodiments of the invention, taken in conjunction with the accompanying drawing wherein

FIG. 3 is an enlarged end view of the car, taken along line III of FIG. 1; and

FIG. 4 is a fragmentary and schematic top view of another embodiment of a rail loading and unloading car of the present invention.

Figure 2:
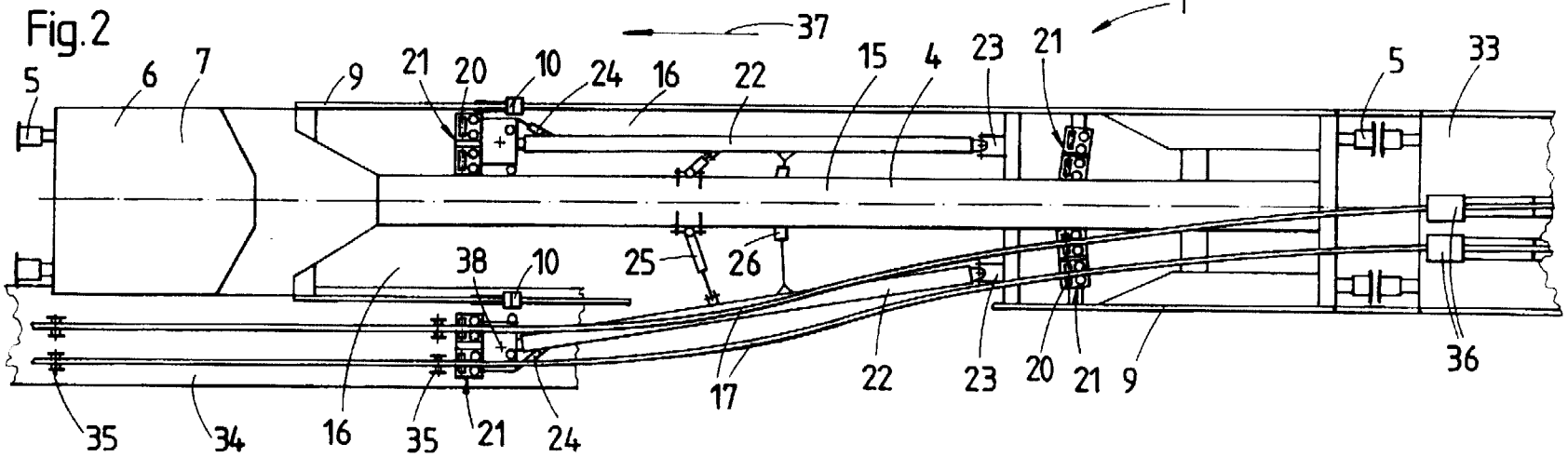
FIG. 2 is a top view of FIG. 1, showing two elongated rails being loaded at one side of the car.

To make the illustration clearer, the gantry crane has been omitted from FIGS. 2 and 3.

DETAILED DESCRIPTION OF THE PREFERRED EMBODIMENTS

Figure 1:
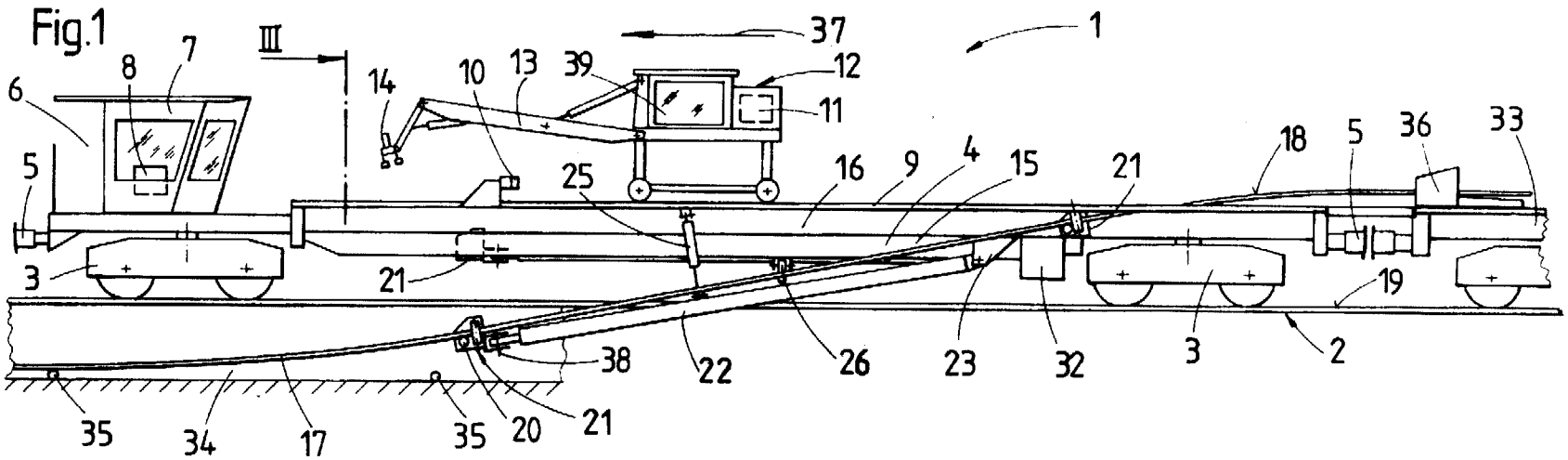
FIG. 1 shows a side elevational view of a car for loading and unloading elongated rails, with a gantry crane running in a longitudinal direction.

Referring now to the drawing, wherein like reference numerals designate like parts operating in a like manner, and first to FIGS. 1 to 3, there is shown car 1 for loading and unloading elongated rails 17, the car being movable along track 2 extending in a longitudinal direction indicated by arrow 37 and defining track plane 19. Car 1 comprises frame 4 extending in the longitudinal direction and supported on track 2 at opposite ends by undercarriages 3. The car forms part of a train and may be coupled to a succeeding car 33 by coupling 5 at a rear end of the car frame, another coupling 5 being provided at receiving end 6 of the car frame. Two rails 9 for supporting gantry crane 12 are affixed to frame 4 and extend in the longitudinal direction along the sides of the car frame, rails 9 being spaced from each other in a direction extending transversely to the longitudinal direction. Bumpers 10 are mounted on rails 9 at the rail ends facing receiving end 6 of car 1 to keep gantry crane 12 from running off rails 9. The gantry crane carries operator's cab 39 and has jib 13 pivotal in all directions and equipped at its outer end with rail gripping device 14. Gantry crane 12 is movable along rails 9 by drive 11.

In the embodiment shown in FIGS. 1 to 3, frame 4 comprises carrier beam 15 extending in the longitudinal direction and a respective one of clearances 16 is positioned on each side of the carrier beam which extends centrally between the clearances. The clearances are spaced from each other in a direction extending transversely to the longitudinal direction and extend between undercarriages 3 for permitting elongated rails 17 to be guided therethrough. Guiding roller arrangement 21 is arranged to guide a respective one of elongated rails 17 through each clearance 16 between track plane 19 and loading plane 18 above frame 4. Each guiding roller arrangement is positioned in a respective clearance 16. The undercarriages support opposite ends of frame 4, and clearance 16 is positioned between the two rails 9 for supporting crane 12 and is delimited in the longitudinal direction by undercarriages 3.

In the illustrated embodiment, two adjacently positioned elongated rails 17 are stored in ditch 34 running parallel to track 2 in the track shoulder and are supported there on conveying rollers 35 which precede guiding roller arrangement 21. Guiding roller arrangement 21 comprises outrigger 22 extending in the longitudinal direction and having opposite ends, and guiding roller means 20 is mounted on one of the outrigger ends. Universal joint 23 connects the outrigger end opposite to the one end to frame 4. As is shown in detail in FIG. 3, guiding roller means 20 is comprised of vertical guide rollers 27, spaced from each other in a direction extending transversely to the longitudinal direction and freely rotatable about vertical axes 28, and horizontal guide rollers 29 below the vertical guide rollers and freely rotatable about horizontal axes 30. These guide rollers define guide channels 31 for elongated rails 17 and hold the rails against tilting while they are guided therein.

Guiding roller means 20 is pivotally mounted on the one outrigger end, and drive 24 links the guiding roller means to the one outrigger end for pivoting the guiding roller means about vertical axis 38 (see FIG. 2). Furthermore, drives 25, 26 link outrigger 22 to frame 4 for adjusting the outrigger in a vertical direction and a direction extending transversely to the longitudinal direction. Further guiding roller arrangement 21 is arranged to guide a respective one of elongated rails 17 between track plane 19 and loading plane 18 above frame 4, the further guiding roller arrangement being mounted on the frame just below the loading plane between universal joint 23 and an adjacent one of the undercarriages 3.

As shown in FIG. 1, car 1 further comprises operator's cab 7 equipped with central control 8 mounted on an end of frame 4 remote from universal joint 23. Also, the car frame carries a power plant 32 for supplying energy to drives 24, 25, 26.

In the embodiment illustrated in FIG. 4, frame 4 comprises two carrier beams 15 extending in the longitudinal direction and being spaced from each other in a direction extending transversely to the longitudinal direction, and a single clearance 16 is defined between the two carrier beams to enable two elongated rails 17 to be guided therethrough in the center of car 1. The two crane supporting rails 9 are affixed to the two carrier beams.

In operation, gantry crane 12 is moved as close as possible to receiving end 6 of car 1. The ends of elongated rails 17 stored in ditch 34 are then clamped to rail gripping device 14 which has been lowered into the ditch by jib 13. Pivoting drives 25, 26 are operated to move outrigger 22 so that guiding roller arrangement 21 is also lowered into the ditch, as shown in the drawing. Drive 11 is now actuated to move gantry crane 12 along rails 9 in a direction opposite to the one indicated by arrow 37, which causes elongated rails 17, whose ends are clamped by rail gripping device 14, to be guided into guide channels 31. Subsequently, the ends of elongated rails 17 are again clamped to rail gripping device 14 behind guiding roller arrangement 21 mounted on outrigger 22. Pivoting drive 24 enables the elongated rails guided in roller guide means 20 to be repositioned so as to influence the flexing line of the elongated rails to facilitate the guidance of the elongated rails into further guiding roller arrangement 21. After elongated rails 17 have been detached from rail gripping device 14, car 1 is moved with the train along track 2 in the direction indicated by arrow 37, causing the elongated rails guided by guiding roller arrangements 21 and further guide arrangements 36 on succeeding cars 33 to be automatically moved along the succeeding car or cars of the train.

What is claimed is:

1. A car for loading and unloading elongated rails, the car being movable along a track extending in a longitudinal direction and defining a track plane, which comprises (a) a frame having an upper surface extending in a substantially flat horizontal plane in the longitudinal direction, the frame (1) being supported on the track by undercarriages and (2) defining at least one opening extending in the substantially flat horizontal plane to form a clearance extending between the undercarriages in the longitudinal direction for permitting the elongated rails to be guided therethrough between the track plane and a loading plane above the upper frame surface, (b) a guiding roller arrangement positioned in the clearance for guiding a respective one of the elongated rails through the clearance between the track and loading planes, and (c) two rails for supporting a crane, the rails being affixed to the frame and extending in the longitudinal direction, and the rails being spaced from each other in a direction extending transversely to the longitudinal direction.

2. The car of claim 1, wherein the frame comprises a carrier beam extending in the longitudinal direction and a respective one of the clearances is positioned on each side of the carrier beam which extends centrally between the clearances.

3. The car of claim 1, wherein the frame comprises two carrier beams extending in the longitudinal direction and being spaced from each other in a direction extending transversely to the longitudinal direction, and the clearance is defined between the two carrier beams.

4. The car of claim 1, wherein the undercarriages support opposite ends of the frame, the clearance is positioned between the two rails for supporting a crane and is delimited in the longitudinal direction by the undercarriages.

5. The car of claim 1, wherein the guiding roller arrangement comprises an outrigger extending in the longitudinal direction and having opposite ends, and guiding roller means mounted on one of the outrigger ends, further comprising a universal joint connecting the outrigger end opposite to the one end to the frame.

6. The car of claim 5, wherein the guiding roller means is pivotally mounted on the one outrigger end, further comprising a drive linking the guiding roller means to the one outrigger end for pivoting the guiding roller means.

7. The car of claim 5, further comprising drive means linking the outrigger to the frame for adjusting the outrigger in a vertical direction and a direction extending transversely to the longitudinal direction.

8. The car of claim 5, further comprising an operator's cab equipped with a central control mounted on an end of the frame remote from the universal joint.

9. The car of claim 5, comprising a further guiding roller arrangement arranged to guide a respective one of the elongated rails between the track plane and the loading plane above the frame, the further guiding roller arrangement being mounted on the frame between the universal joint and an adjacent one of the undercarriages.

* * * * *